US011586141B2

(12) United States Patent
Iino

(10) Patent No.: US 11,586,141 B2
(45) Date of Patent: Feb. 21, 2023

(54) IMAGE FORMING APPARATUS INCLUDING GUIDE RAILS CONFIGURED TO GUIDE PROCESS CARTRIDGE

(71) Applicant: BROTHER KOGYO KABUSHIKI KAISHA, Nagoya (JP)

(72) Inventor: Hikaru Iino, Niwa (JP)

(73) Assignee: BROTHER KOGYO KABUSHIKI KAISHA, Nagoya (JP)

( * ) Notice: Subject to any disclaimer, the term of this patent is extended or adjusted under 35 U.S.C. 154(b) by 0 days.

(21) Appl. No.: 17/541,740

(22) Filed: Dec. 3, 2021

(65) Prior Publication Data

US 2022/0197212 A1 Jun. 23, 2022

(30) Foreign Application Priority Data

Dec. 18, 2020 (JP) ..... JP2020-210569

(51) Int. Cl.
*G03G 21/18* (2006.01)
*G03G 21/16* (2006.01)

(52) U.S. Cl.
CPC ..... *G03G 21/1853* (2013.01); *G03G 21/1647* (2013.01); *G03G 2221/1654* (2013.01); *G03G 2221/1869* (2013.01)

(58) Field of Classification Search
CPC ..... G03G 21/1647; G03G 21/1842; G03G 21/1853; G03G 2221/1654; G03G 2221/1869
See application file for complete search history.

(56) References Cited

U.S. PATENT DOCUMENTS

2005/0084290 A1* 4/2005 Baek ..... 399/121
2008/0145095 A1* 6/2008 Hoshi ..... G03G 21/1853 399/111
2009/0304412 A1 12/2009 Hattori et al.
2013/0051843 A1* 2/2013 Tong ..... G03G 21/1853 399/107
2014/0369714 A1* 12/2014 Suzuki ..... 399/110

FOREIGN PATENT DOCUMENTS

EP 2645182 A2 * 10/2013
JP 2009-162904 A 7/2009

* cited by examiner

*Primary Examiner* — Sophia S Chen
(74) *Attorney, Agent, or Firm* — Merchant & Gould P.C.

(57) ABSTRACT

A cartridge frame includes a protruding rib protruding toward a first frame, a first bearing supporting one end of a photosensitive drum in an axial direction, and a second bearing supporting an other end of the photosensitive drum in the axial direction. The first frame includes a first guide rail configured to, when a process cartridge is attached to an apparatus main body, guide the protruding rib to slide along the first guide rail. A second frame includes a second guide rail configured to, when the process cartridge is attached to the apparatus main body, guide the second bearing to slide along the second guide rail. A size of the first guide rail in a width direction perpendicular to both the axial direction and an attachment direction of the process cartridge is smaller than a size of the second guide rail in the width direction.

19 Claims, 13 Drawing Sheets

IMAGE FORMING APPARATUS INCLUDING GUIDE RAILS CONFIGURED TO GUIDE PROCESS CARTRIDGE

CROSS REFERENCE TO RELATED APPLICATIONS

This application claims priority from Japanese Patent Application No. 2020-210569 filed Dec. 18, 2020. The entire content of the priority application is incorporated herein by reference.

BACKGROUND

An image forming apparatus includes a process cartridge having a photosensitive drum and attachable to and detachable from an apparatus main body, a frame supporting one end of the process cartridge in the axial direction of the photosensitive drum, and a frame supporting the other end of the process cartridge in the axial direction.

SUMMARY

According to one aspect, this specification discloses an image forming apparatus. The image forming apparatus includes an apparatus main body and a process cartridge. The apparatus main body includes a first frame and a second frame apart from each other. The first frame includes a first guide rail. The second frame includes a second guide rail. The process cartridge includes a cartridge frame and a photosensitive drum supported by the cartridge frame. The photosensitive drum is rotatable about an axis extending in an axial direction. The process cartridge is attachable to the apparatus main body in an attachment direction. One end of the process cartridge in the axial direction is supported by the first frame. An other end of the process cartridge in the axial direction is supported by the second frame. The cartridge frame includes: a protruding rib protruding toward the first frame, the first guide rail configured to, when the process cartridge is attached to the apparatus main body, guide the protruding rib to slide along the first guide rail; a first bearing supporting one end of the photosensitive drum in the axial direction; and a second bearing supporting an other end of the photosensitive drum in the axial direction, the second guide rail configured to, when the process cartridge is attached to the apparatus main body, guide the second bearing to slide along the second guide rail. A size of the first guide rail in a width direction perpendicular to both the axial direction and the attachment direction is smaller than a size of the second guide rail in the width direction.

According to the above configuration, since the first guide rail guides the protruding rib of the cartridge frame instead of the first bearing that supports the one end of the photosensitive drum, the size of the first guide rail in the width direction is reduced. This reduces the space occupied by the first guide rail in the first frame, and increases the degree of freedom in arranging parts in the first frame.

BRIEF DESCRIPTION OF THE DRAWINGS

Embodiments in accordance with this disclosure will be described in detail with reference to the following figures wherein.

DETAILED DESCRIPTION

In the image forming apparatus described above, when the process cartridge is attached to the apparatus main body, a bearing that supports one end in the axial direction of the photosensitive drum is guided by a guide rail formed in a frame supporting one end of the process cartridge, and a drum shaft that protrudes from the other end in the axial direction of the photosensitive drum is guided by a guide rail formed in a frame supporting the other end of the process cartridge.

In a case where the bearing of the photosensitive drum and the drum shaft are guided by the guide rail of the frame as described above, the size of the guide rail in the width direction crossing both the axial direction and the attachment-detachment direction of the process cartridge tends to be large. As the width of the guide rail increases, the space occupied by the guide rail in the frame increases, and the degree of freedom in arranging parts in the frame decreases.

In view of the foregoing, an aspect of an objective of this disclosure is to provide an image forming apparatus configured to reduce the space in the frame occupied by the guide rail for guiding the process cartridge that is attached to the apparatus main body and to increase the degree of freedom in arranging parts in the frame.

Next, an aspect of this disclosure will be described with reference to the accompanying drawings.

[Image Forming Apparatus]

Figure 1:
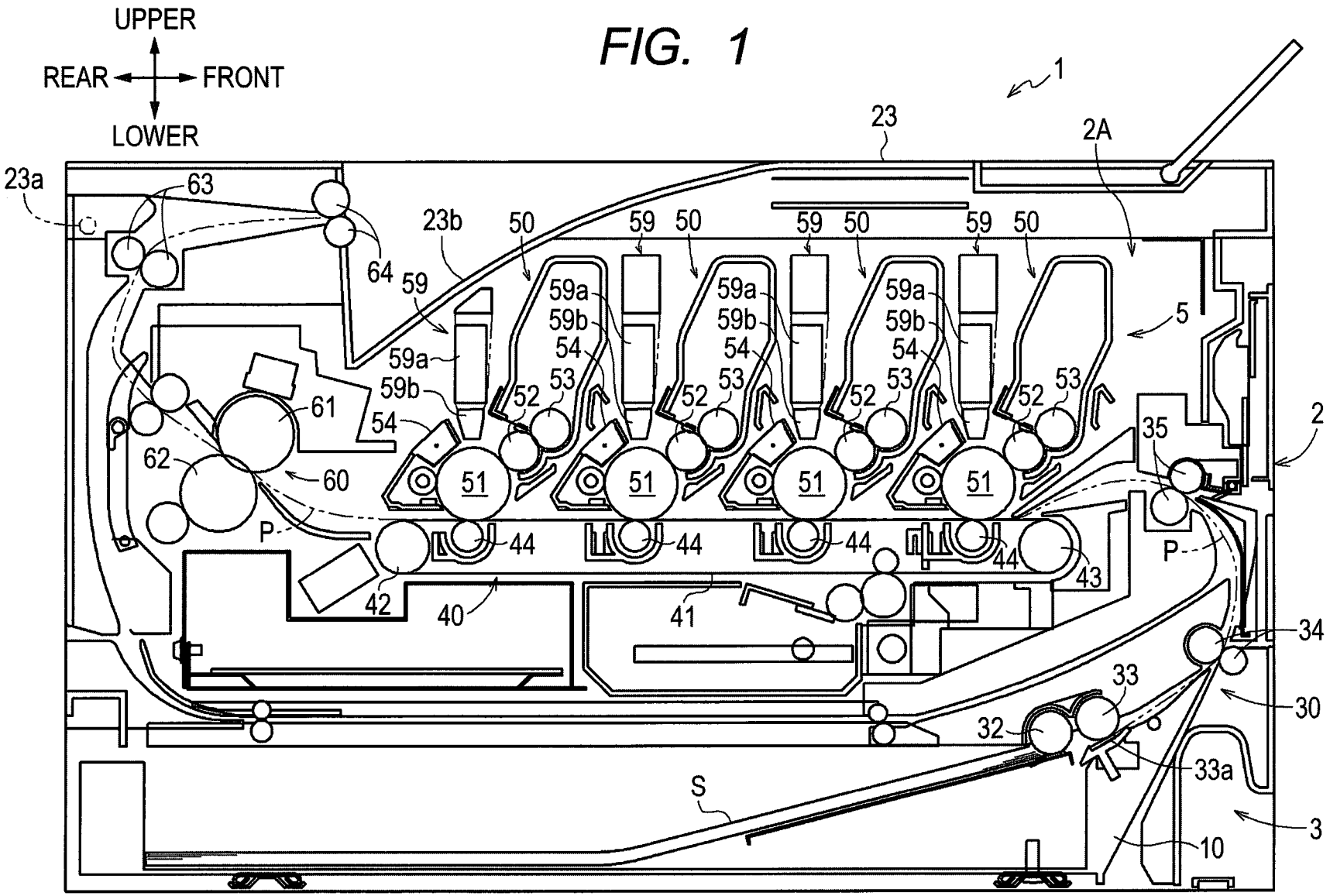
FIG. 1 is a central cross-sectional view showing an image forming apparatus.

An image forming apparatus 1 shown in FIG. 1 is a color laser printer that forms an image of a plurality of colors on a sheet S by an electrophotographic method.

In the following description, the right side in FIG. 1 is defined as the front side of the image forming apparatus 1, the left side in FIG. 1 is defined as the rear side of the image forming apparatus 1, the near side in the direction perpendicular to the drawing surface in FIG. 1 is defined as the left side of the image forming apparatus 1, and the far side in the direction perpendicular to the drawing surface in FIG. 1 is defined as the right side of the image forming apparatus 1. Further, the upper side and the lower side in FIG. 1 are defined as the upper side and the lower side of the image forming apparatus 1, respectively.

The image forming apparatus 1 includes an apparatus main body 2, a paper feed unit 3, and an image forming unit 5. The paper feed unit 3 includes a paper feed tray 10 that supports a sheet S and a paper conveyance unit 30 that conveys the sheet S. The image forming unit 5 forms an image on the sheet S that has been conveyed by the paper feed unit 3.

The apparatus main body 2 is formed in a substantially rectangular parallelepiped shape, and accommodates the paper feed unit 3 and the image forming unit 5. An opening 2A is opened on the upper surface of the apparatus main body 2. The apparatus main body 2 includes a top cover 23 that covers the opening 2A so as to be open and close.

The top cover 23 is configured to be pivotable about a pivot shaft 23*a* at the rear end, and is movable between a closed position for closing the opening 2A and an open position for opening the opening 2A by pivoting about the pivot shaft 23*a*. The top cover 23 of the apparatus main body 2 is formed with a paper discharge tray 23*b* that inclines downward from the front side toward the rear side.

The paper feed unit 3 is arranged at the lower part of the apparatus main body 2, and conveys the sheet S supported by the paper feed tray 10 to the image forming unit 5 by the paper conveyance unit 30. The paper feed tray 10 is configured to be slidable in the front-rear direction. The paper feed tray 10 is configured to be movable between an accommodated position accommodated in the apparatus main body 2 and a separation position pulled forward from the accommodated position.

The paper conveyance unit 30 includes a paper feed roller 32, a separation roller 33, a separation pad 33*a*, a conveyance roller pair 34, and a registration roller pair 35. Within the apparatus main body 2, a conveyance path P for the sheet S from the paper feed tray 10 to the paper discharge tray 23*b* through the image forming unit 5 is formed.

The sheet S supported by the paper feed tray 10 is separated one sheet at a time by the paper feed roller 32, the separation roller 33, and the separation pad 33*a*, and is sent out to the conveyance path P. The paper feed roller 32 is a roller that conveys the sheet S from the paper feed tray 10 toward the image forming unit 5. The separation roller 33 and the separation pad 33*a* constitute a separation means for separating the sheet S supported by the paper feed tray 10 one sheet at a time.

The sheet S sent out to the conveyance path P is conveyed toward the image forming unit 5 by the conveyance roller pair 34 and the registration roller pair 35. The registration roller pair 35 regulates the movement of the leading end of the sheet S that is conveyed and temporarily stops the sheet S, and then conveys the sheet S toward the image forming unit 5 at a particular timing.

The image forming unit 5 is arranged above the paper feed unit 3, and includes four process cartridges 50 arranged in the front-rear direction. Each process cartridge 50 is provided for each of the black, yellow, magenta, and cyan colors. The process cartridges 50 are detachably attached to the apparatus main body 2. Each process cartridge 50 includes a photosensitive drum 51, a development roller 52, a supply roller 53, and a charger 54.

Figure 3:
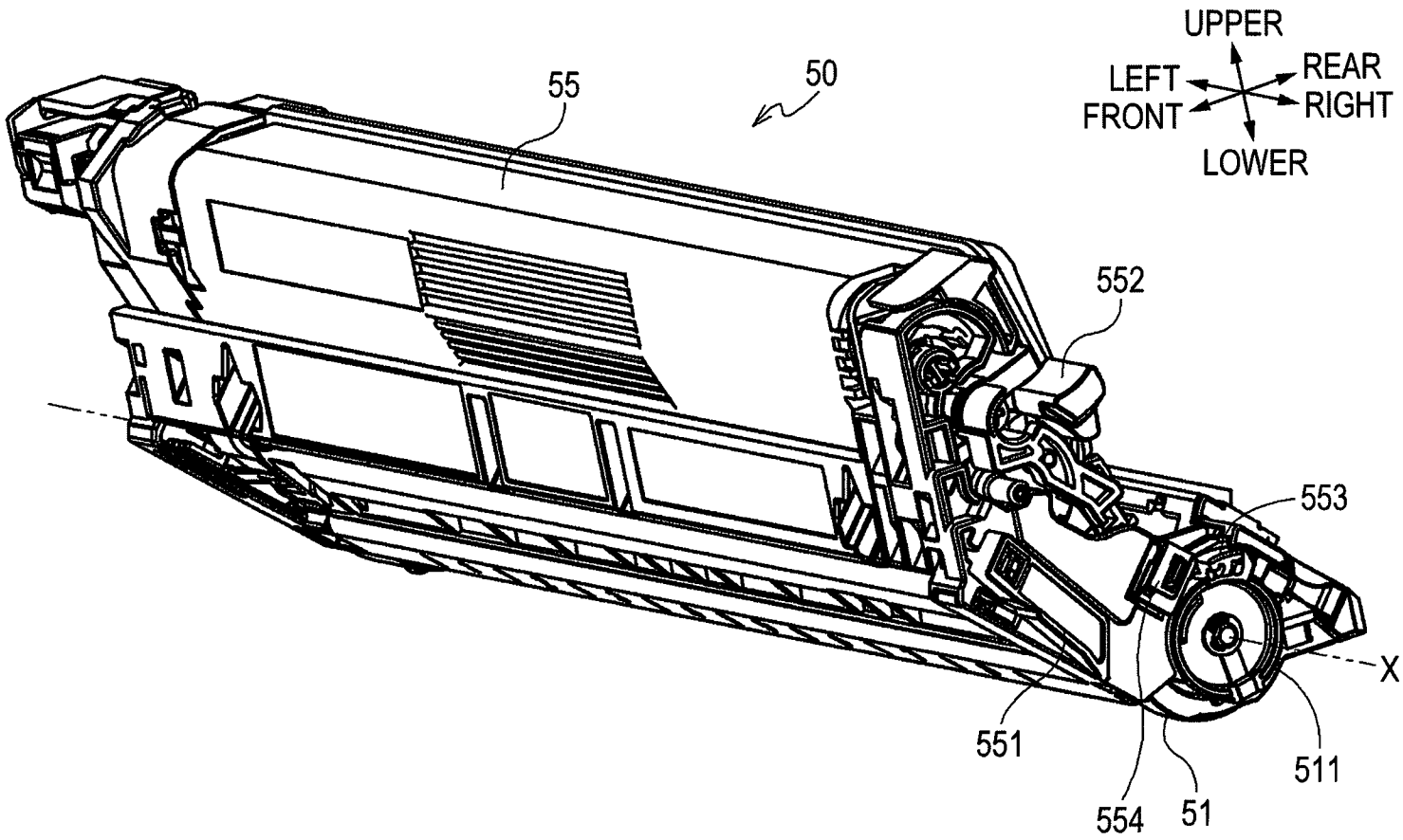
FIG. 3 is a perspective view of a process cartridge as viewed from the front right side.
Figure 4:
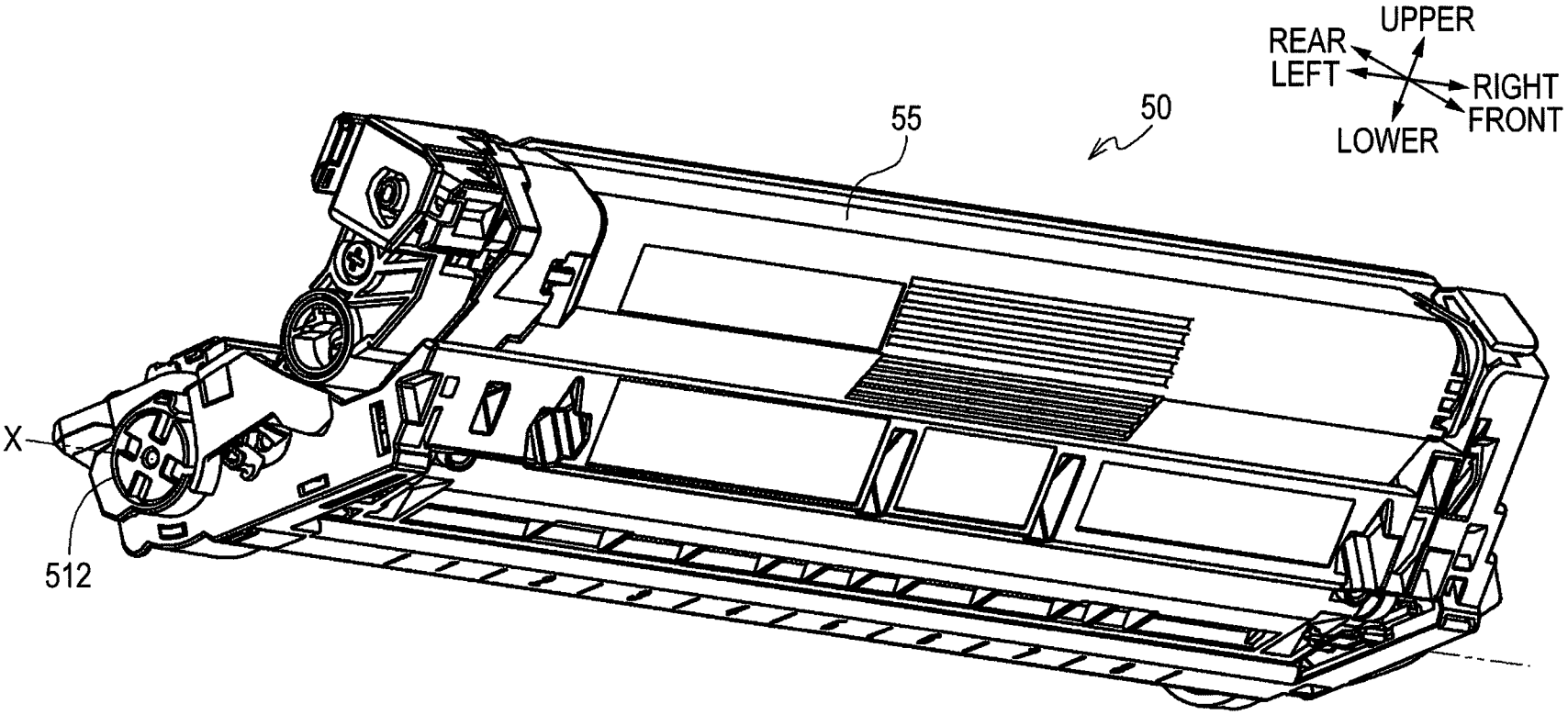
FIG. 4 is a perspective view of the process cartridge as viewed from the front left side.

The process cartridge 50 is attached to the apparatus main body 2 in an orientation that an axis X (see FIG. 3) of the photosensitive drum 51 extends in the left-right direction. The left-right direction is an example of an axial direction. The development roller 52 is configured to be movable between a contact position at which the development roller 52 contacts the photosensitive drum 51 and a separation position at which the development roller 52 is separated from the photosensitive drum 51. The supply roller 53 supplies the toner contained in the process cartridge 50 to the development roller 52. The charger 54 charges the photosensitive drum 51.

The apparatus main body 2 includes an exposure head 59 for exposing the surface of the photosensitive drum 51. The exposure head 59 is an example of an exposure device. The exposure head 59 is supported by the top cover 23. Four exposure heads 59 are provided for respective ones of the photosensitive drums 51, and the exposure heads 59 are arranged in the front-rear direction.

The exposure head 59 has a main body 59*a* extending downward from the top cover 23 and an exposure portion 59*b* arranged at the lower end of the main body 59*a*. The exposed portion 59*b* is arranged adjacent to the upper side of the photosensitive drum 51 in a state where the top cover 23 is closed. The exposure unit 59*b* is an LED array including a plurality of LED elements arranged in the left-right direction.

A transfer belt 41 is arranged to face the lower side of the photosensitive drums 51 with the conveyance path P interposed therebetween. The transfer belt 41 is stretched between a drive roller 42 and a follow roller 43 arranged in front of the drive roller 42. The transfer belt 41, the drive roller 42, and the follow roller 43 constitute a belt device 40. A transfer roller 44 is arranged at a position facing each photosensitive drum 51 with the transfer belt 41 interposed therebetween.

In the image forming unit 5, the photosensitive drum 51 uniformly charged by the charger 54 is selectively exposed by the exposure head 59. By this exposure, electric charges are selectively removed from the surface of the photosensitive drum 51, and an electrostatic latent image is formed on the surface of the photosensitive drum 51.

The toner contained in the process cartridge 50 is positively charged between the supply roller 53 and the development roller 52, and is supported on the surface of the development roller 52. A development bias is applied to the development roller 52, and when the electrostatic latent image formed on the photosensitive drum 51 faces the development roller 52, toner is supplied from the development roller 52 to the electrostatic latent image due to the potential difference between the electrostatic latent image and the development roller 52. In this way, a toner image is formed on the surface of the photosensitive drum 51.

When the sheet S conveyed toward the image forming unit 5 reaches the transfer belt 41, the sheet S is conveyed by the transfer belt 41 and sequentially passes between the transfer belt 41 and each photosensitive drum 51. Then, the toner image on the surface of the photosensitive drum 51 is transferred to the sheet S by the transfer bias applied to the transfer roller 44 when the toner image faces the sheet S.

The transfer belt 41 in the present embodiment is configured as a conveyance belt that conveys the sheet S to which the toner image is transferred. Alternatively, the transfer belt may be configured as an intermediate transfer belt in which a toner image is transferred to the belt itself and the toner image transferred to the belt is further transferred to the sheet S.

The sheet S on which the toner image is transferred is conveyed to a fixing device 60. The fixing device 60 includes a heating roller 61 and a pressure roller 62 in pressure contact with the heating roller 61. The sheet S conveyed to the fixing device 60 passes between the heating roller 61 and the pressure roller 62 and the toner image is thermally fixed.

The sheet S on which the toner image is thermally fixed is conveyed from the fixing device 60 to the downstream side in the conveyance direction, and is further conveyed by an intermediate paper discharge roller pair 63 and a paper discharge roller pair 64 arranged downstream of and the intermediate paper discharge roller pair 63 in the conveyance direction, and is discharged to the paper discharge tray 23*b*.

Figure 2:
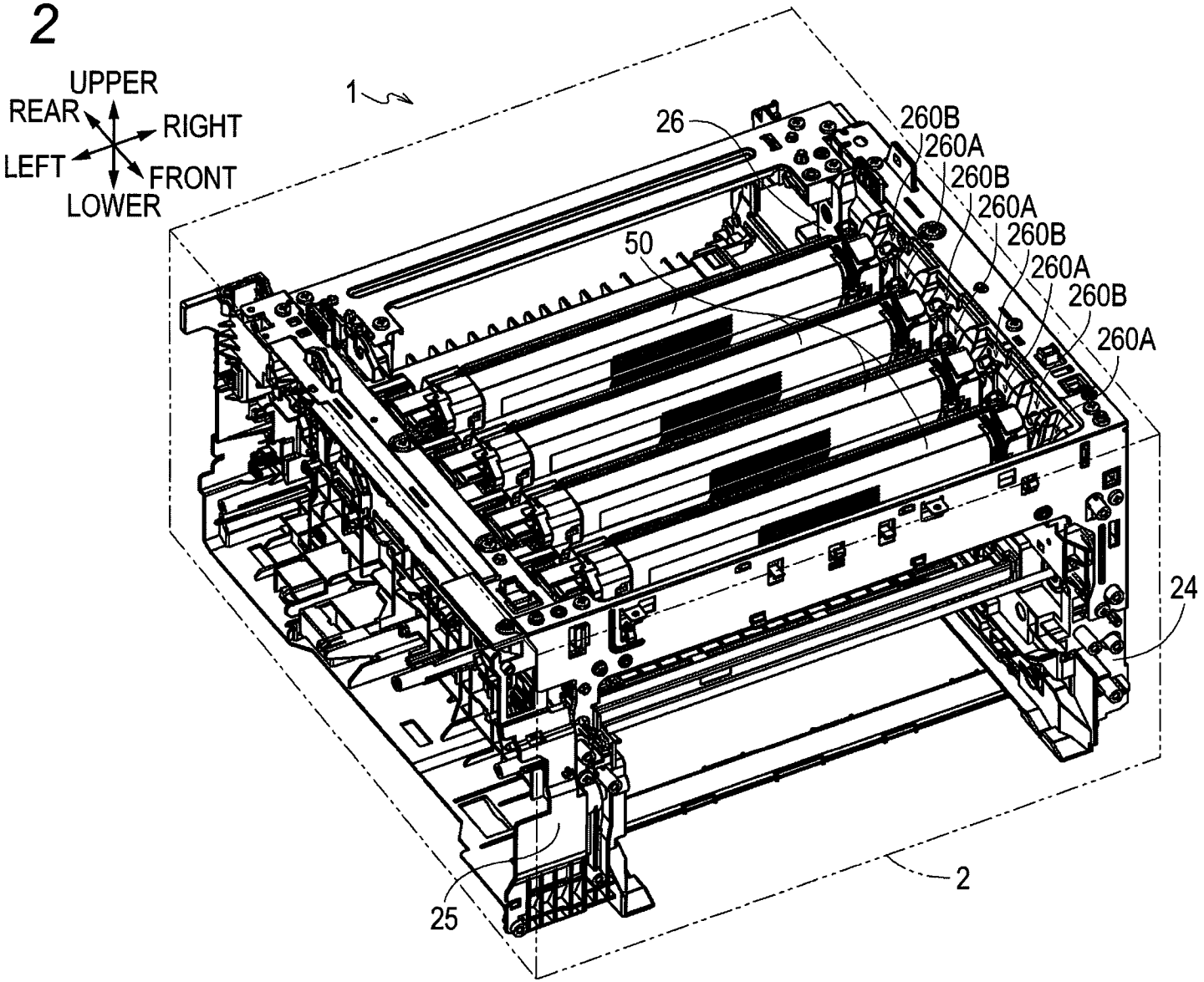
FIG. 2 is a perspective view showing the inside of an apparatus main body.

As shown in FIG. 2, the apparatus main body 2 includes a right main body frame 24 and a left main body frame 25 which are arranged apart from each other in the left-right direction. The right main body frame 24 is located at the right end of the apparatus main body 2 and extends in the front-rear direction and the upper-lower direction. The left main body frame 25 is located at the left end of the apparatus main body 2 and extends in the front-rear direction and the upper-lower direction. A support frame 26 is attached to an inside surface of the right main body frame 24, which is the surface facing the left main body frame 25. The support frame 26 is an example of a first frame, and the left main body frame 25 is an example of a second frame. The right main body frame 24 (an example of a third frame) is located at the outer side of the support frame 26 in the axial direction.

The process cartridge 50 is arranged between the support frame 26 and the left main body frame 25, and is detachably supported by the support frame 26 and the left main body frame 25. The support frame 26 is located to the right of the process cartridge 50 and supports the right end of the process cartridge 50. The left main body frame 25 is located to the left of the process cartridge 50 and supports the left end of the process cartridge 50. The right end is an example of one end in the axial direction, and the left end is an example of the other end in the axial direction.

[Process Cartridge]

As shown in FIGS. 3 to 6, the process cartridge 50 has a cartridge frame 55 that supports the photosensitive drum 51 and the development roller 52.

Figure 5A:
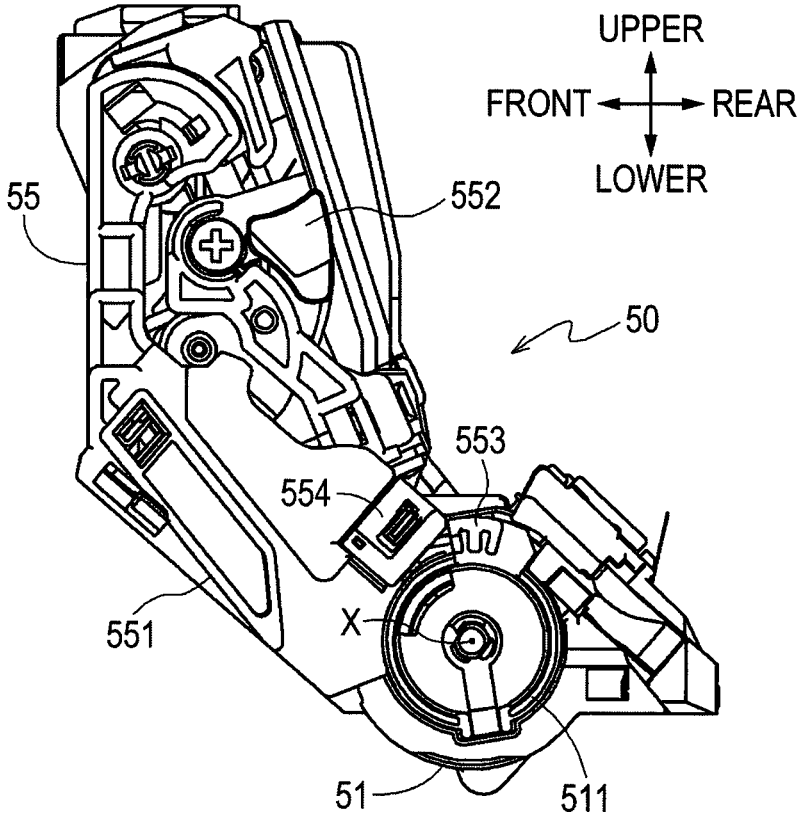
FIG. 5A is a right side view showing the process cartridge.
Figure 5B:
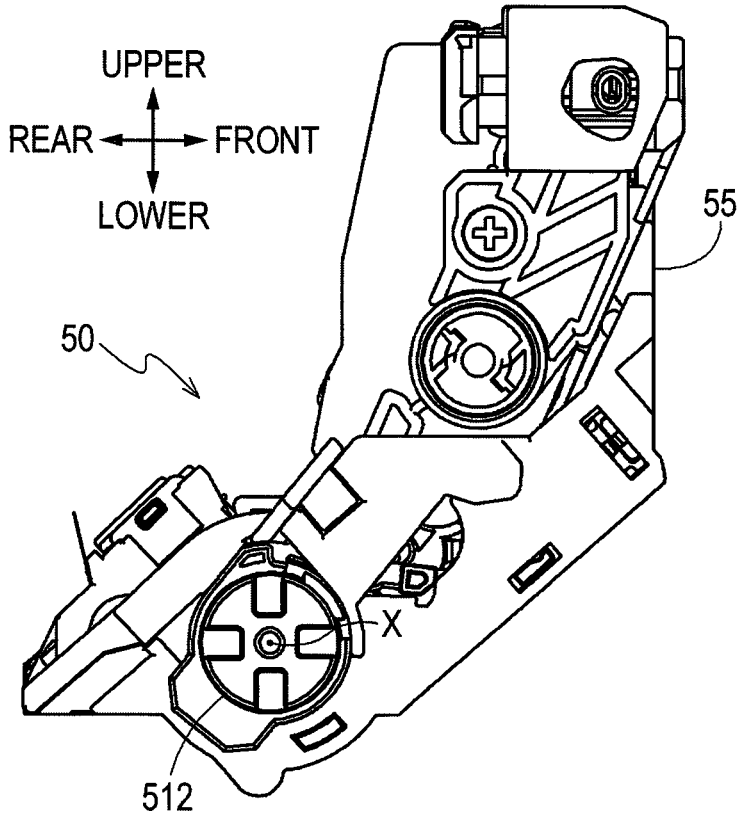
FIG. 5B is a left side view showing the process cartridge.
Figure 6:
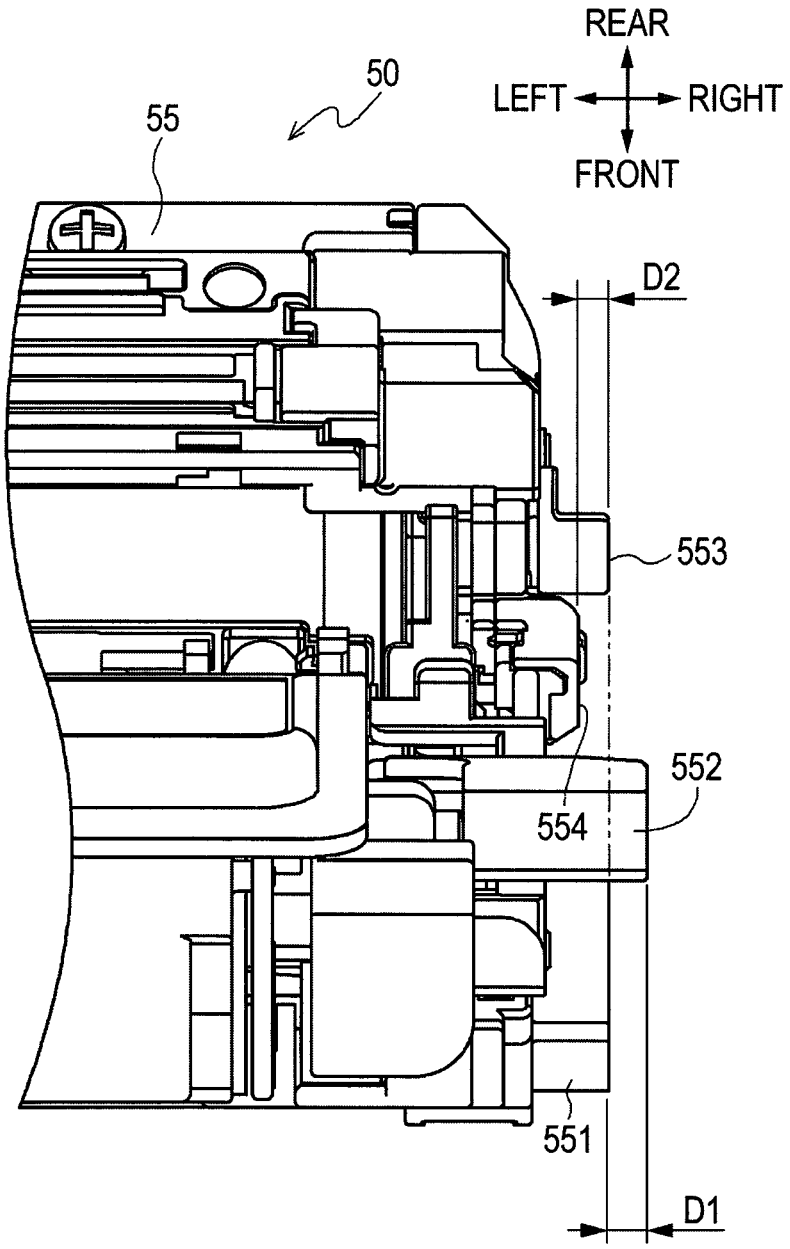
FIG. 6 is a plan view showing a right end portion of the process cartridge.

A protruding rib 551 and a first bearing 511 are provided at the right end of the cartridge frame 55. The protruding rib 551 protrudes toward the support frame 26. The first bearing 511 supports one end of the photosensitive drum 51 in the axial direction X. A second bearing 512 is provided at the left end of the cartridge frame 55. The second bearing 512 supports the other end of the photosensitive drum 51 in the axial direction X. The protruding rib 551 may be integrally molded with the cartridge frame 55, for example. As shown in FIG. 5A, the protruding rib 551 is located at a position spaced from the first bearing 511. The protruding rib 551 is located upstream of the first bearing 511 in the attachment direction in which the process cartridge 50 is attached to the apparatus main body 2.

An arm 552, a lever contact portion 553, and an electrode 554 protruding toward the support frame 26 are provided at the right end of the cartridge frame 55. The arm 552, the lever contact portion 553, and the electrode 554 are examples of protruding members.

The arm 552 is a member for moving the development roller 52 between the contact position and the separation position. When no pressing force is applied to the arm 552, the development roller 52 moves to the contact position. When the arm 552 is pressed from above, the development roller 52 moves to the separation position. The arm 552 is supported by the cartridge frame 55.

The arm 552 is formed such that the protruding amount toward the support frame 26 is larger than that of the protruding rib 551. That is, the protruding position (outermost position) of the arm 552 in the axial direction is located farther outward than the protruding position (outermost position) of the protruding rib 551 in the axial direction (see FIG. 6). The difference in the protruding amount of the arm 552 and the protruding rib 551 toward the support frame 26 is a protruding amount difference D1.

Figure 10:
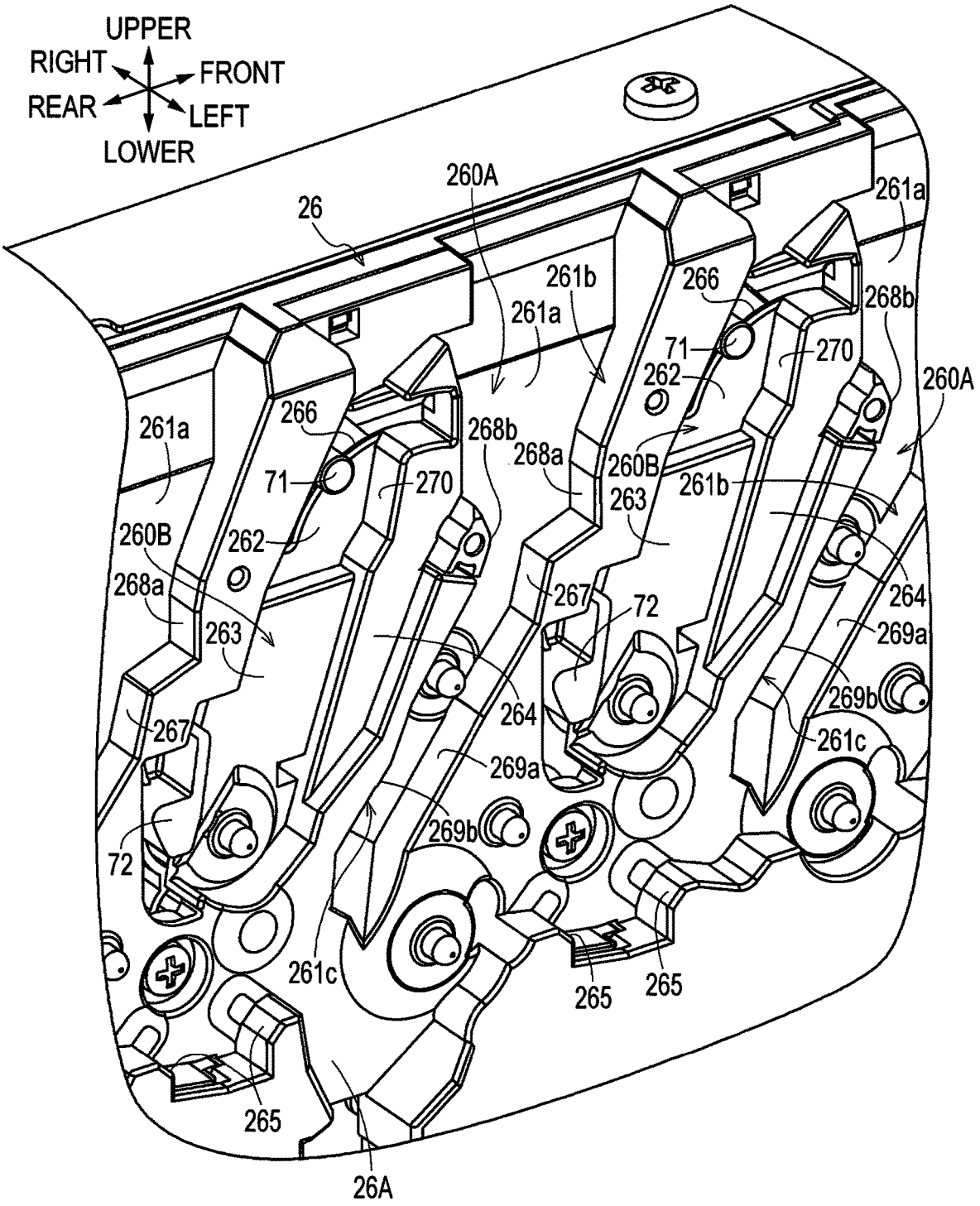
FIG. 10 is a perspective view showing the left side of the support frame.
Figure 11:
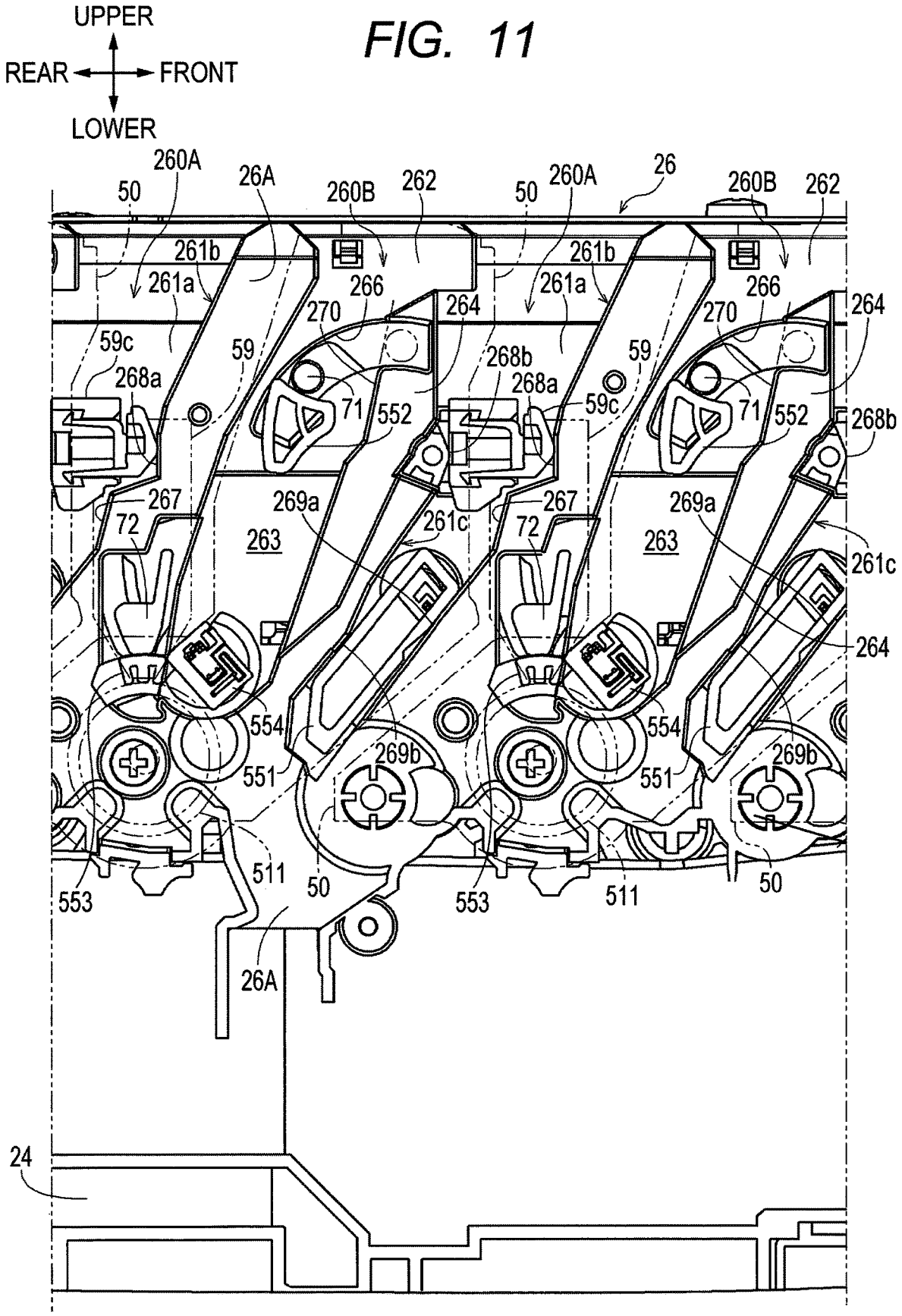
FIG. 11 is a left side view showing the relationship among protruding ribs and protruding members of the process cartridge, a positioning portion of the exposure head, and each portion of the support frame.

The apparatus main body 2 includes a boss 71 configured to press the arm 552 (see FIGS. 10 and 11). The boss 71 is movable to a pressing position for pressing the arm 552 of the process cartridge 50 and a retracted position separated from the arm 522.

When the boss 71 moves to the pressing position, the arm 552 is pressed by the boss 71, and the development roller 52 moves to the separation position. When the boss 71 moves to the retracted position, the boss 71 is separated from the arm 522 and the development roller 52 moves to the contact position. That is, the boss 71 moves the development roller 52 between the contact position and the separation position.

The apparatus main body 2 includes a lock lever 72 (see FIGS. 10 and 11) that presses and fixes the photosensitive drum 51 when the process cartridge 50 is attached to the apparatus main body 2, and the lock lever 72 contacts the lever contact portion 553. The lock lever 72 is supported by the support frame 26. The lever contact portion 553 is formed at the first bearing 511. The protruding amount of the lever contact portion 553 toward the support frame 26 is the same as that of the protruding rib 551. That is, the protruding position (outermost position) of the lever contact portion 553 in the axial direction is the same as the protruding position (outermost position) of the protruding rib 551 in the axial direction (see FIG. 6).

The electrode 554 is an electrode for supplying power to the charger 54, and the charger 54 and the electrode 554 are supported by the cartridge frame 55. The electrode 554 is formed such that the protruding amount toward the support frame 26 is smaller than that of the protruding rib 551. That is, the protruding position (outermost position) of the electrode 554 in the axial direction is located farther inward than the protruding position (outermost position) of the protruding rib 551 in the axial direction (see FIG. 6). The difference in the protruding amount of the electrode 554 and the protruding rib 551 toward the support frame 26 is a protruding amount difference D2.

[Exposure Head]

Figure 7:
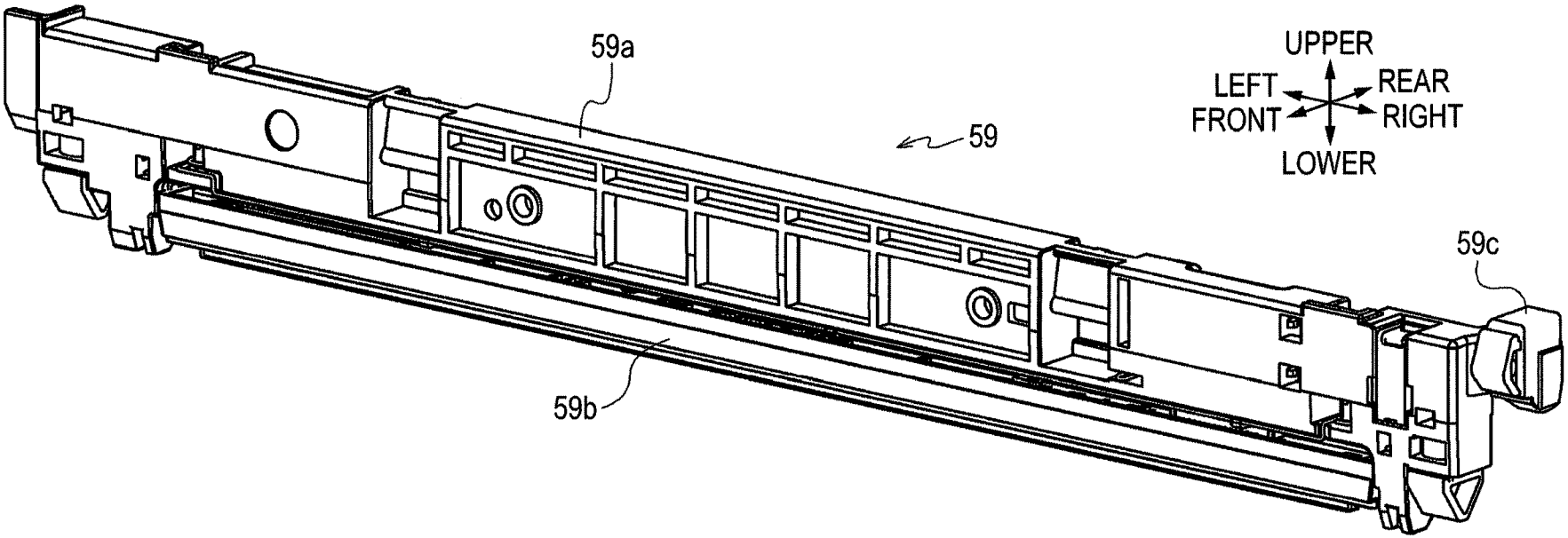
FIG. 7 is a perspective view showing an exposure head.

As shown in FIG. 7, the exposure head 59 has a positioning portion 59*c* at the right end of the main body 59*a*. The image forming apparatus 1 is configured such that the positioning portion 59*c* contacts the support frame 26 to restrict the movement of the exposure head 59 in the front-rear direction. The front-rear direction is an example of a horizontal direction perpendicular to the axial direction X.

[Support Frame]

As shown in FIGS. 8 to 11, the support frame 26 has an inner side surface 26A facing the process cartridge 50 in the axial direction X and an outer side surface 26B opposite to the inner side surface 26A and facing the right main body frame 24 in the axial direction X. The inner side surface 26A is an example of a first side surface.

The support frame 26 has a first guide rail 260A and a retracting rail 260B. The first guide rail 260A and the retracting rail 260B are formed at the inner side surface 26A side of the support frame 26. Each of the first guide rail 260A and the retracting rail 260B is formed at four locations along the front-rear direction, corresponding to the number of process cartridges 50 supported by the support frame 26.

When the process cartridge 50 is attached to the apparatus main body 2, the first guide rail 260A guides the protruding rib 551 by making sliding contact with the protruding rib 551 of the process cartridge 50. The size (dimension) of the first guide rail 260A in a width direction perpendicular to both the attachment-detachment direction of the process cartridge 50 and the axial direction X is a width Wa.

The first guide rail 260A has a first guide surface 261*a*, a first step surface 261*b*, and a second step surface 261*c*. The first guide surface 261*a* is located farther rightward than the inner side surface 26A, that is, farther outward than the inner side surface 26A in the axial direction X.

The first step surface 261*b* is formed between the inner side surface 26A and one end of the first guide surface 261*a* in the width direction of the first guide rail 260A. The second step surface 261*c* is formed between the inner side surface 26A and the other end of the first guide surface 261*a* in the width direction of the first guide rail 260A.

The first step surface 261*b* and the second step surface 261*c* are formed between the inner side surface 26A and the first guide surface 261*a* in the width direction of the first guide rail 260A. The first step surface 261*b* is located at the front side of the second step surface 261*c*.

The first guide rail 260A forms a groove shape recessed outward from the inner side surface 26A in the axial direction X by the first guide surface 261*a*, the first step surface 261*b*, and the second step surface 261*c*.

At least part of the first guide surface 261*a* is arranged at a position overlapping the trajectory of the protruding rib 551 when the process cartridge 50 is attached to the apparatus main body 2 when viewed from the axial direction X, and makes sliding contact with the protruding rib 551 when the process cartridge 50 is attached to the apparatus main body 2. The first guide surface 261*a* guides the protruding rib 551 by making sliding contact with the protruding rib 551. When the protruding rib 551 is guided by the first guide surface 261*a*, positioning in the left-right direction of the process cartridge 50 attached to the apparatus main body 2 is realized.

The retracting rail 260B is formed in a groove shape recessed outward from the inner side surface 26A in the axial direction X such that when the process cartridge 50 is attached to the apparatus main body 2, the protruding members such as the arm 552, the lever contact portion 553, and the electrode 554 do not interfere with the retracting rail 260B. The retracting rail 260B has a first retracting surface 262, a second retracting surface 263, and a third retracting surface 264.

The first retracting surface 262 is located farther rightward than the inner side surface 26A, that is, farther outward than the inner side surface 26A in the axial direction X. The first retracting surface 262 is located farther rightward than the first guide surface 261*a*, that is, farther outward than the first guide surface 261*a* in the axial direction X. The difference in position between the first retracting surface 262 and the first guide surface 261*a* in the axial direction X is a position difference W1. The position difference W1 is equal to or larger than the protruding amount difference D1 (W1≥D1).

At least part of the first retracting surface 262 is arranged at a position overlapping the trajectory of the arm 552 when the process cartridge 50 is attached to the apparatus main body 2 when viewed from the axial direction X. The protruding amount of the arm 552 toward the support frame 26 is larger than that of the protruding rib 551 by the protruding amount difference D1.

However, since the first retracting surface 262 is located at the right side of the first guide surface 261*a* by the position difference W1, in a state where the protruding rib 551 of the process cartridge 50 is guided by the first guide surface 261*a* when the process cartridge 50 is attached to the apparatus main body 2, the first retracting surface 262 and the arm 552 are in sliding contact with each other or are separated from each other in the axial direction X. That is, since the first retracting surface 262 is in a position retracted from the arm 552 in the axial direction X and does not interfere with the arm 552 when the process cartridge 50 is attached to the apparatus main body 2, the attaching operation of the process cartridge 50 is unlikely to be hindered.

The second retracting surface 263 is located farther rightward than the inner side surface 26A, that is, farther outward than the inner side surface 26A in the axial direction X. The second retracting surface 263 is at the same position as the first guide surface 261*a* in the axial direction X.

At least part of the second retracting surface 263 is arranged at a position overlapping the trajectory of the lever contact portion 553 when the process cartridge 50 is attached to the apparatus main body 2 when viewed from the axial direction X. The protruding amount of the lever contact portion 553 toward the support frame 26 is the same as that of the protruding rib 551, and the second retracting surface 263 and the first guide surface 261*a* are at the same positions in the axial direction X.

Therefore, in a state where the protruding rib 551 of the process cartridge 50 is guided by the first guide surface 261*a* when the process cartridge 50 is attached to the apparatus main body 2, the second retracting surface 263 and the lever contact portion 553 are in sliding contact with each other in the axial direction X. That is, since the second retracting surface 263 is in a position retracted from the lever contact portion 553 in the axial direction X, and does not interfere with the lever contact portion 553 when the process cartridge 50 is attached to the apparatus main body 2, the attaching operation of the process cartridge 50 is unlikely to be hindered.

The third retracting surface 264 is located farther rightward than the inner side surface 26A, that is, farther outward than the inner side surface 26A in the axial direction X. The third retracting surface 264 is located farther leftward than the first guide surface 261*a*, that is, farther inward than the first guide surface 261*a* in the axial direction X. The difference in position between the third retracting surface 264 and the first guide surface 261*a* in the axial direction X is a position difference W2. The position difference W2 is equal to or smaller than the protruding amount difference D2 (W2≥D2).

At least part of the third retracting surface 264 is arranged at a position overlapping the trajectory of the electrode 554 when the process cartridge 50 is attached to the apparatus main body 2 when viewed from the axial direction X. The third retracting surface 264 is located at the left side of the first guide surface 261*a* by the position difference W2.

However, since the protruding amount of the electrode 554 toward the support frame 26 is smaller than that of the protruding rib 551 by the protruding amount difference D2, in a state where the protruding rib 551 of the process cartridge 50 is guided by the first guide surface 261*a* when the process cartridge 50 is attached to the apparatus main body 2, the third retracting surface 264 and the electrode 554 are in sliding contact with each other or are separated from each other in the axial direction X. That is, since the third retracting surface 264 is in a position retracted from the electrode 554 in the axial direction X and does not interfere with the electrode 554 when the process cartridge 50 is attached to the apparatus main body 2, the attaching operation of the process cartridge 50 is unlikely to be hindered.

A positioning portion 265 is provided at the inner side surface 26A of the support frame 26. The positioning portion 265 contacts the first bearing 511 supporting one end of the photosensitive drum 51 to position the photosensitive drum 51 when the process cartridge 50 is attached to the apparatus main body 2. The positioning portion 265 is located farther leftward than the inner side surface 26A, that is, farther inward than the inner side surface 26A in the axial direction X. The positioning portion 265 is configured to support the first bearing 511 of the process cartridge 50 attached to the apparatus main body 2 from below.

In a state where the first bearing 511 is supported by the positioning portion 265, when the lock lever 72 contacts the lever contact portion 553 of the first bearing 511 from above, the photosensitive drum 51 is fixed in a positioned state.

In this way, since the positioning of the photosensitive drum 50 is realized by the positioning portion 265 formed at the support frame 26, in a configuration that the protruding rib 551 of the process cartridge 50 is guided by the first guide rail 260A when the process cartridge 50 is attached to the apparatus main body 2, the positional accuracy of the photosensitive drum 51 is maintained.

The support frame 26 has a through-hole 266 that penetrates in the left-right direction and is formed in an arc shape. The through-hole 266 is mainly formed in a portion of the first retracting surface 262 of the support frame 26. Each of the positioning portion 265 and the through-hole 266 is formed at four locations along the front-rear direction, corresponding to the number of process cartridges 50 supported by the support frame 26.

The first guide rail 260A has a restricting portion 267, a first positioning portion 268*a* (an example of a first exposure positioning portion), a second positioning portion 268*b* (an example of a second exposure positioning portion), a third positioning portion 269*a* (an example of a first rib positioning portion), and a fourth positioning portion 269*b* (an example of a second rib positioning portion).

The restricting portion 267 is formed at the first step surface 261*b* of the first guide rail 260A. The restricting portion 267 restricts the movement of the process cartridge 50 toward the front side by contacting the protruding rib 551 of the process cartridge 50 that is attached to and detached from the apparatus main body 2.

The first positioning portion 268*a* is formed at the first step surface 261*b* of the first guide rail 260A. The first positioning portion 268*a* contacts the front surface of the positioning portion 59*c* of the exposure head 59 extending downward from the top cover 23 at the closed position. When the first positioning portion 268*a* contacts the front surface of the positioning portion 59*c*, the movement of the exposure head 59 toward the front side is restricted. The front side is an example of one side in the horizontal direction perpendicular to the axial direction X.

The second positioning portion 268*b* is formed at the second step surface 261*c* of the first guide rail 260A. The second positioning portion 268*b* contacts the rear surface of the positioning portion 59*c* of the exposure head 59 extending downward from the top cover 23 at the closed position. When the second positioning portion 268*b* contacts the rear surface of the positioning portion 59*c*, the movement of the exposure head 59 toward the rear side is restricted. The rear side is an example of the other side in the horizontal direction perpendicular to the axial direction X.

In this way, the first positioning portion 268*a* contacts the front surface of the positioning portion 59*c* and the second positioning portion 268*b* contacts the rear surface of the positioning portion 59*c* such that the positioning portion 59*c* is sandwiched between the first positioning portion 268*a* and the second positioning portion 268*b*. In this way, the positioning of the exposure head 59 in the front-rear direction is realized.

The third positioning portion 269*a* is formed at the first step surface 261*b* of the first guide rail 260A. The third positioning portion 269*a* contacts the front surface of the protruding rib 551 of the process cartridge 50 attached to the apparatus main body 2. Since the third positioning portion 269*a* contacts the front surface of the protruding rib 551, the movement of the process cartridge 50 attached to the apparatus main body 2 to one side in the width direction of the first guide rail 260A is restricted.

The fourth positioning portion 269*b* is formed at the second step surface 261*c* of the first guide rail 260A. The fourth positioning portion 269*b* contacts the rear surface of the protruding rib 551 of the process cartridge 50 attached to the apparatus main body 2. Since the fourth positioning portion 269*b* contacts the rear surface of the protruding rib 551, the movement of the process cartridge 50 attached to the apparatus main body 2 to the other side in the width direction of the first guide rail 260A is restricted.

In this way, the third positioning portion 269*a* contacts the front surface of the protruding rib 551, and the fourth positioning portion 269*b* contacts the rear surface of the protruding rib 551 such that the protruding rib 551 is sandwiched between the third positioning portion 269*a* and the fourth positioning portion 269*b*. In this way, positioning of the process cartridge 50 attached to the apparatus main body 2 in the width direction of the first guide rail 260A is realized.

The third positioning portion 269*a* and the fourth positioning portion 269*b* are arranged downstream of the first positioning portion 268*a* and the second positioning portion 268*b* in the attachment direction in which the process cartridge 50 is attached to the apparatus main body 2.

In this way, the third positioning portion 269*a* and the fourth positioning portion 269*b* that position the process cartridge 50 are located near the photosensitive drum 51 in the attachment direction in which the process cartridge 50 is attached to the apparatus main body 2, and the positioning accuracy of the photosensitive drum 51 when the process cartridge 50 is attached to the apparatus main body 2 is enhanced.

[Left Main Body Frame]

Figure 12:
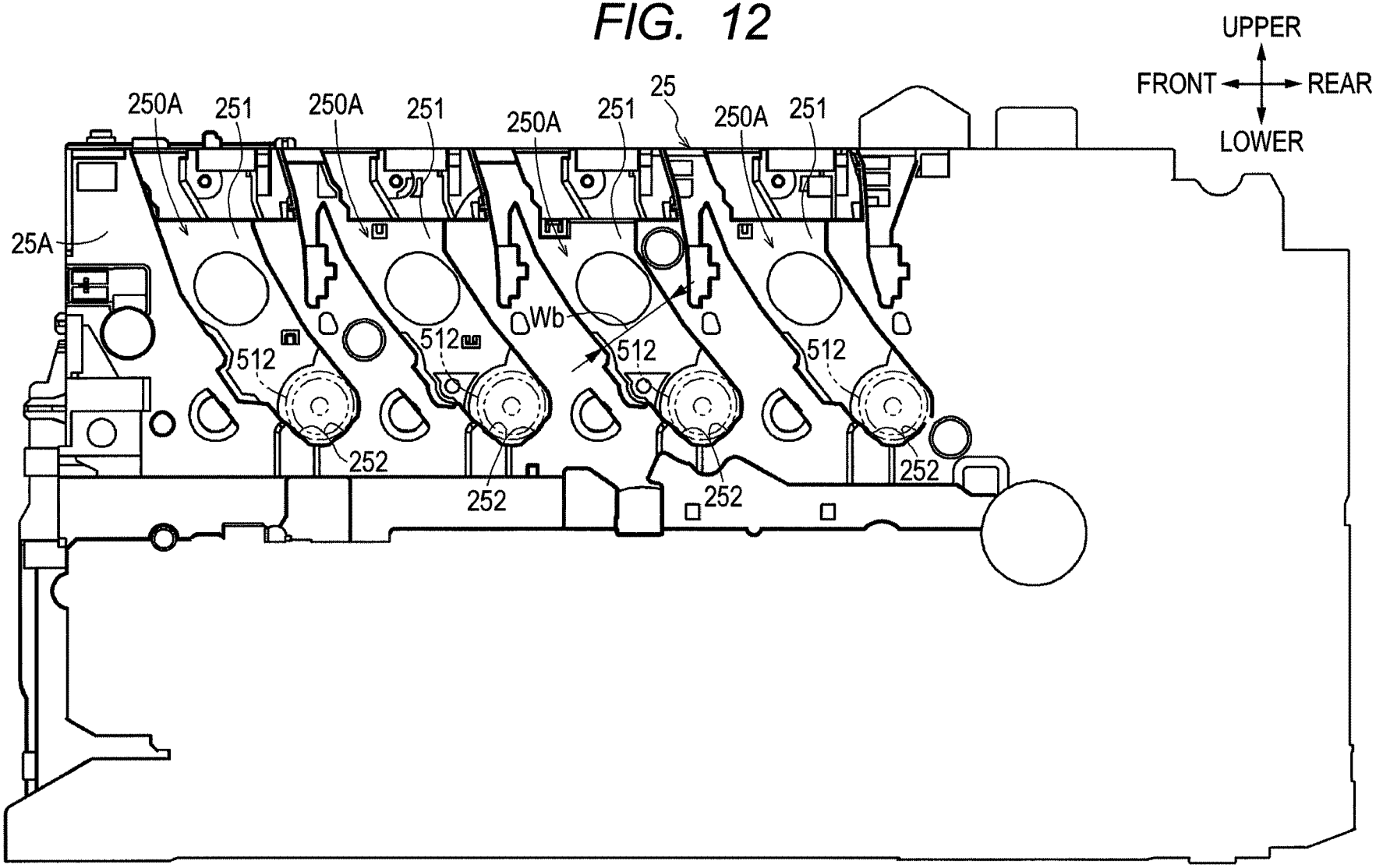
FIG. 12 is a right side view showing a left main body frame.
Figure 13:
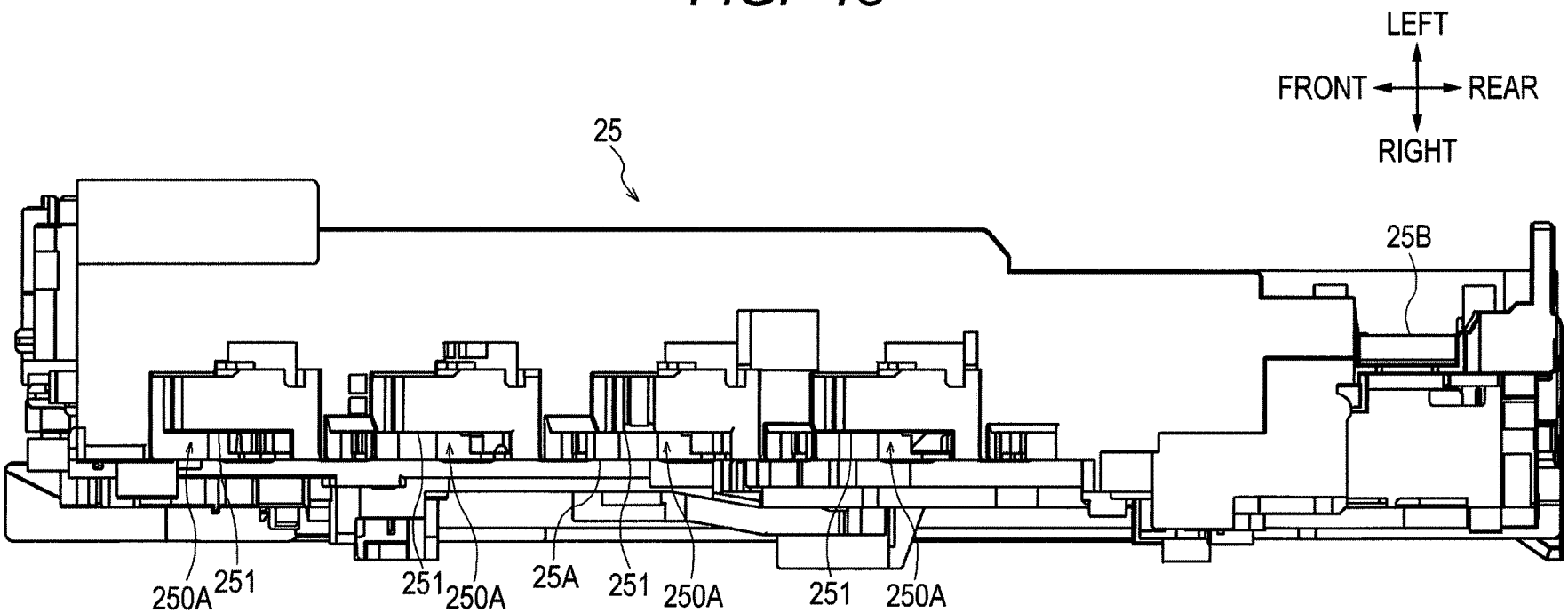
FIG. 13 is a plan view showing the left main body frame.

As shown in FIGS. 12 and 13, the left main body frame 25 has an inner side surface 25A facing the process cartridge 50 in the axial direction X and an outer side surface 25B opposite to the inner side surface 25A.

The left main body frame 25 has a second guide rail 250A. The second guide rail 250A is formed at the inner side surface 25A side of the left main body frame 25. The second guide rail 250A is formed at four locations along the front-rear direction corresponding to the number of process cartridges 50 supported by the left main body frame 25.

The second guide rail 250A guides the second bearing 512 by making sliding contact with the second bearing 512 of the photosensitive drum 51 in the process cartridge 50 when the process cartridge 50 is attached to the apparatus main body 2. The size (dimension) of the second guide rail 250A in the width direction perpendicular to both the axial direction X and the attachment-detachment direction of the process cartridge 50 is a width Wb. The width Wa of the first guide rail 260A is smaller than the width Wb of the second guide rail 250A.

The second guide rail 250A has a second guide surface 251. The second guide surface 251 is located farther leftward than the inner side surface 25A, that is, farther outward than the inner side surface 25A in the axial direction X. The second guide rail 250A is formed in a groove shape in which the second guide surface 251 is recessed from the inner side surface 25A outward in the axial direction X.

At least part of the second guide surface 251 is arranged at a position overlapping the trajectory of the second bearing 512 when the process cartridge 50 is attached to the apparatus main body 2 when viewed from the axial direction X, and makes sliding contact with the second bearing 512 when the process cartridge 50 is attached to the apparatus main body 2. The second guide surface 251 guides the second bearing 512 by making sliding contact with the second bearing 512. When the second bearing 512 is guided by the second guide surface 251, positioning of the process cartridge 50 in the left-right direction is realized.

The second guide rail 250A has a positioning portion 252 that is contacted by the second bearing 512 of the photosensitive drum 51 when the process cartridge 50 is attached to the apparatus main body 2. The positioning portion 252 is formed at the inner side surface 25A side of the left main body frame 25, and is located at the lower end of the second guide rail 250A. The photosensitive drum 51 is positioned by the positioning portion 252 supporting the second bearing 512 of the process cartridge 50 attached to the apparatus main body 2 from below.

[Attaching Operation of Process Cartridge]

When the process cartridge 50 is attached to the apparatus main body 2 in the image forming apparatus 1, the process cartridge 50 is inserted into the apparatus main body 2 from above. In the process cartridge 50 inserted into the apparatus main body 2, the protruding rib 551 of the process cartridge 50 is guided by the first guide rail 260A of the support frame 26, and the second bearing 512 of the process cartridge 50 is moved downward in a state of being guided by the second guide rail 250A of the left main body frame 25.

When the process cartridge 50 moves downward, the first bearing 511 of the photosensitive drum 51 contacts the positioning portion 265, and the second bearing 512 contacts the positioning portion 252, the positioning of the photosensitive drum 51 with respect to the apparatus main body 2 is realized, and the process cartridge 50 is attached to the apparatus main body 2.

In this case, the positioning of the process cartridge 50 in the left-right direction is realized when the protruding rib 551 is guided by the first guide rail 260A and the second bearing 512 is guided by the second guide rail 250A.

As described above, in the process cartridge 50, since the first guide rail 260A guides the protruding rib 551 of the cartridge frame 55 instead of the first bearing 511 that supports one end of the photosensitive drum 50, the width Wa of the first guide rail 260A in the width direction is reduced. In this way, the space occupied by the first guide rail 260A in the support frame 26 is reduced, and the degree of freedom in arrangement of parts in the support frame 26 is increased.

In a state where the protruding rib 551 is guided by the first guide surface 261*a*, the first retracting surface 262 of the retracting rail 260B corresponding to the arm 552 of the process cartridge 50 is at a position retracted from the arm 552, and the arm 552 and the first retracting surface 262 do not interfere with each other. That is, although the protruding amount of the arm 552 toward the support frame 26 is larger than that of the protruding rib 551 by the protruding amount difference D1, since the first retracting surface 262 is at the right side of the first guide surface 261*a* by the position difference W1, the arm 552 and the support frame 26 do not interfere with each other, and the attaching operation of the process cartridge 50 is unlikely to be hindered.

In a state where the protruding rib 551 is guided by the first guide surface 261*a*, the second retracting surface 263 of the retractable rail 260B corresponding to the lever contact portion 553 of the process cartridge 50 is at a position retracted from the lever contact portion 553, and the lever contact portion 553 and the second retracting surface 263 do not interfere with each other. That is, since the protruding amount of the lever contact portion 553 toward the support frame 26 is the same as that of the protruding rib 551, and the second retracting surface 263 and the first guide surface 261*a* are at the same position in the axial direction X, the lever contact portion 553 and the support frame 26 do not interfere with each other, and the attaching operation of the process cartridge 50 is unlikely to be hindered.

Since the second retracting surface 263 and the first guide surface 261*a* are located at the same position in the axial direction X, the space at the outer side surface 26B side of the portion of the support frame 26 where the second retracting surface 263 is formed will not be excessively small. In this way, the degree of freedom in arrangement of parts on the outer side surface 26B side of the support frame 26 is unlikely to be excessively limited.

In a state where the protruding rib 551 is guided by the first guide surface 261*a*, the third retracting surface 264 of the retractable rail 260B corresponding to the electrode 554 of the process cartridge 50 is at a position retracted from the electrode 554, and the electrode 554 and the third retracting surface 264 do not interfere with each other. That is, although the third retracting surface 264 is located at the left side of the first guide surface 261*a* by the difference W2, since the protruding amount of the electrode 554 toward the support frame 26 is smaller than that of the protruding rib 551 by the protruding amount difference D2, the electrode 554 and the support frame 26 do not interfere with each other, and the attaching operation of the process cartridge 50 is unlikely to be hindered.

Since the third retracting surface 264 is located at the left side of the first guide surface 261*a*, the space at the outer side surface 26B side of the portion of the support frame 26 where the third retracting surface 264 is formed is increased. In this way, the degree of freedom in arrangement of parts at the outer side surface 26B side of the support frame 26 is increased.

As described above, in the image forming apparatus 1, the process cartridge 50 has protruding members such as the arm 552, the lever contact portion 553, and the electrode 554. These protruding members are arranged in spaces formed by the first retracting surface 262, the second retracting surface 263, and the third retracting surface 264 of the retracting rail 260B, respectively, and the attaching operation of the process cartridge 50 will not be hindered.

In the image forming apparatus 1, when the process cartridge 50 attached to the apparatus main body 2 is taken out, the protruding rib 551 is guided by the first guide surface 261*a*, the arm 552, the lever contact portion 553, and the electrode 554 do not interfere with the first retracting surface 262, the second retracting surface 263, and the third retracting surface 264, respectively.

In the image forming apparatus 1, the protruding amount of the arm 552 toward the support frame 26 is larger than that of the protruding rib 551 by the protruding amount difference D1, the protruding amount of the lever contact portion 553 toward the support frame 26 is the same as that of the protruding rib 551, and the protruding amount of the electrode 554 toward the support frame 26 is smaller than that of the protruding rib 551 by the protruding amount difference D2.

The first retracting surface 262 is located at the right side of the first guide surface 261*a* by the position difference W1, the second retracting surface 263 is located at the same position as the first guide surface 261*a* in the axial direction X, and the third retracting surface 264 is located at the left side of the first guide surface 261*a* by the position difference W2.

In this way, the first guide surface 261*a*, the first retracting surface 262, the second retracting surface 263, and the third retracting surface 264 are located so as to correspond to the protruding amounts of the arm 552, the protruding rib 551, the lever contact portion 553, and the electrode 554 toward the support frame 26. This enhances the degree of freedom in arrangement of parts of the support frame 26 while suppressing the arm 552, the lever contact portion 553, and the electrode 554 from interfering with the support frame 26.

The boss 71 configured to press the arm 552 of the process cartridge 50 is supported by the outer side surface 26B of the support frame 26. As shown in FIG. 10, the boss 71 protrudes leftward from the first retracting surface 262 through the through-hole 266 from the position between the support frame 26 and the right main body frame 24 in the axial direction X. That is, the boss 71 penetrates the first retracting surface 262 in the axial direction X and protrudes toward the process cartridge 50 side. The boss 71 moves between a pressing position and a retracted position along the arc shape of the through-hole 266.

As shown in FIGS. 10 and 11, the retracting rail 260B has a step surface 270 between the first retracting surface 262 and the third retracting surface 264, and the boss 71 is configured to be located on the rear side (the position indicated by a solid line in FIG. 11) of the step surface 270 when the boss 71 is at the pressing position in the front-rear direction and to be located at the front side (the position indicated by a two-dot chain line in FIG. 11) of the step surface 270 when the boss 71 is at the retracted position.

Figure 8:
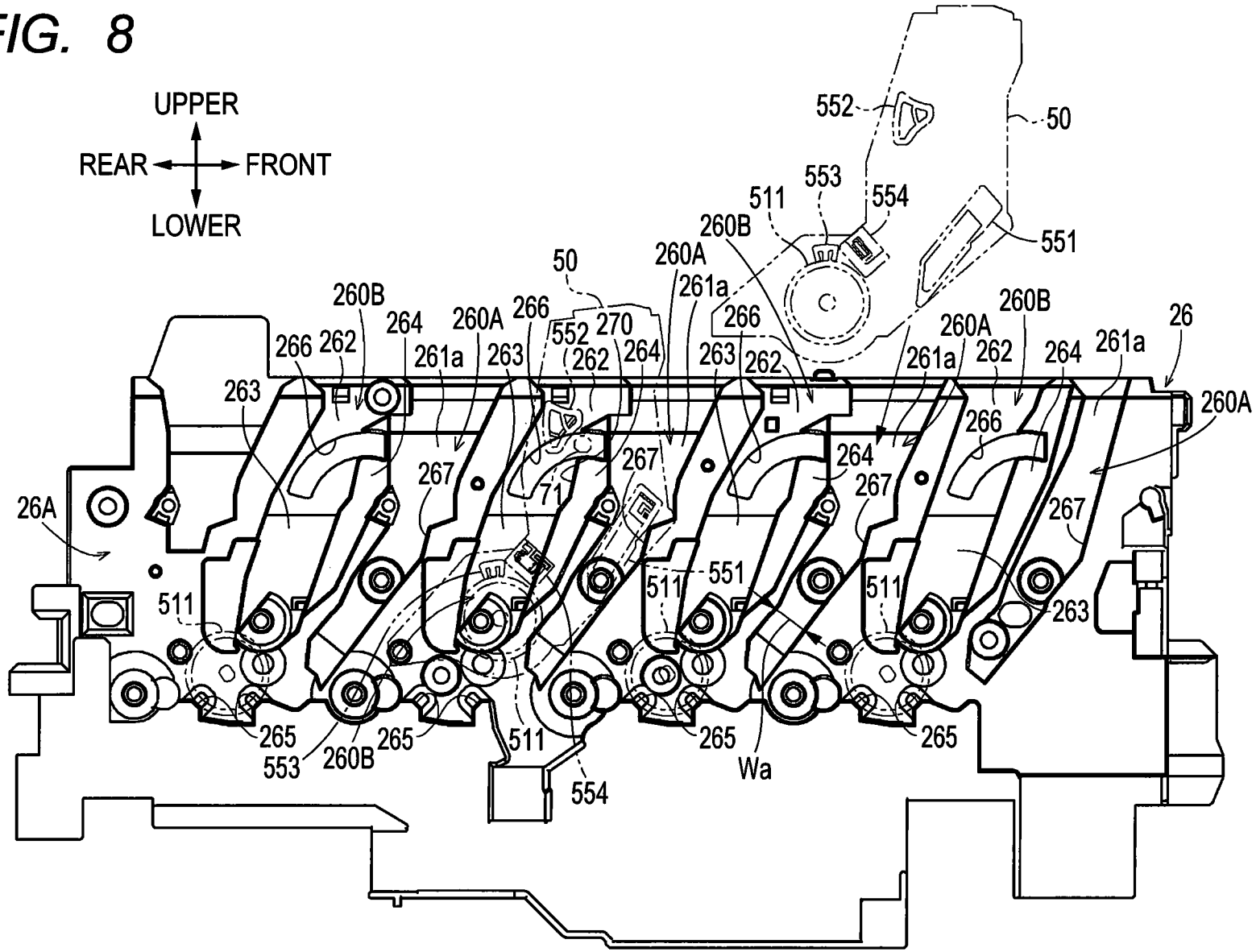
FIG. 8 is a left side view showing a support frame.
Figure 9:
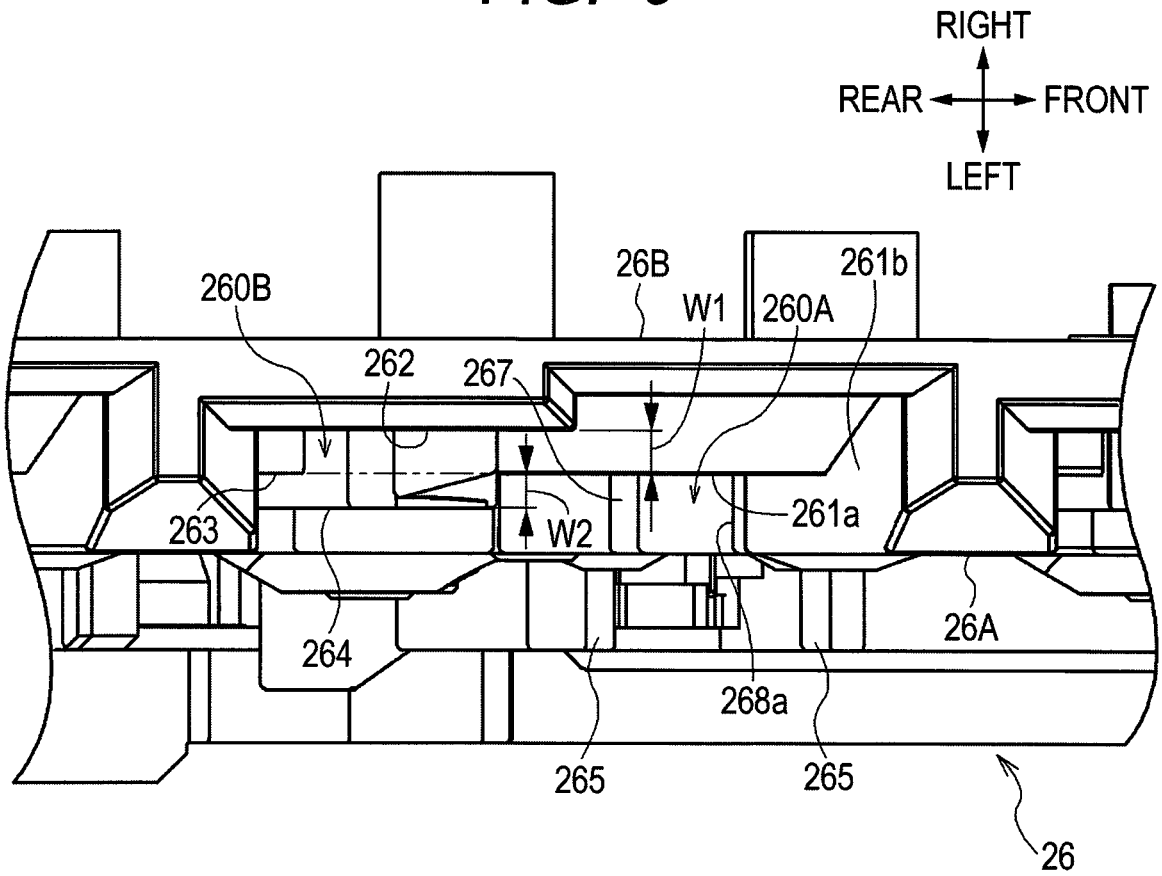
FIG. 9 is a plan view showing the support frame.

Since the boss 71 is attached to the support frame 26 with play in the moving direction, a portion of the boss 71 may protrude rearward from the step surface 270 even when the boss 71 is at the retracted position (see FIG. 8). In this way, when the process cartridge 50 is attached to the apparatus main body in a state where the boss 71 protrudes rearward from the step surface 270, the boss 71 may interfere with the arm 552 passing through the first retracting surface 262 having the through-hole 266 and the boss 71 may be moved toward the pressing position by the arm 552.

Therefore, in the image forming apparatus 1, the restricting portion 267 is formed at the first step surface 261*b* of the first guide rail 260A. Thus, when the process cartridge 50 is attached to the apparatus main body 2, the restricting portion 267 and the protruding rib 551 of the process cartridge 50 contact each other whereby the movement of the process cartridge 50 toward the front side is restricted.

Since the movement of the process cartridge 50 toward the front side is restricted by the restricting portion 267, the trajectory of the arm 552 when the process cartridge 50 is attached to the apparatus main body 2 is restricted to a position where the arm 552 and the boss 71 do not interfere with each other, and unexpected movement of the boss 71 is suppressed. If the trajectory of the arm 552 when the process cartridge 50 is attached to the apparatus main body 2 is restricted to a position where the arm 552 and the boss 71 do not interfere with each other, the restricting portion 267 may be formed at the second step surface 261*c*.

In the image forming apparatus 1, the process cartridge 50 is attached to the apparatus main body 2 from above, and the protruding rib 551 is located at the lower side of the process cartridge 50 when the process cartridge 50 is in a posture (the posture shown in FIG. 8) of being attached to the apparatus main body 2. In particular, when the process cartridge 50 is in a posture of being attached to the apparatus main body 2, a part of the protruding rib 551 overlaps the photosensitive drum 50 located at the lower end of the process cartridge 50 when viewed from the horizontal direction (the front-rear direction).

Therefore, the protruding rib 551 is guided by the first guide rail 260A from the start of attaching the process cartridge 50 to the apparatus main body 2, and the process cartridge 50 is easily attached to the apparatus main body 2.

In the image forming apparatus 1, the attachment direction in which the process cartridge 50 is attached to the apparatus main body 2 is inclined relative to the vertical direction such that the upstream side of the process cartridge 50 in the attachment direction is located farther frontward than the downstream side of the process cartridge 50 in the horizontal direction perpendicular to the axial direction X. The first guide rail 260A and the retracting rail 260B are generally inclined rearward from the upper end side toward the lower end side. That is, the upper end of the first guide rail 260A is located farther frontward than the lower end is, and the upper end of the retracting rail 260B is located farther frontward than the lower end is.

The first guide rail 260A is arranged at the front side of the retracting rail 260B. The front side is one side in the horizontal direction perpendicular to the axial direction X.

In the image forming apparatus 1, when the user attaches the process cartridge 50 to the apparatus main body 2, the process cartridge 50 is inserted into the apparatus main body 2 from the front side. Since the first guide rail 260A for guiding the protruding rib 551 is arranged at the front side of the retracting rail 260B, the visibility of the first guide rail 260A from the user is improved, and the mountability of the process cartridge 50 is improved (that is, an attaching operation of the process cartridge 50 becomes easier).

While the disclosure has been described in detail with reference to the above aspects thereof, it would be apparent to those skilled in the art that various changes and modifications may be made therein without departing from the scope of the claims.

What is claimed is:

1. An image forming apparatus comprising:

an apparatus main body including a first frame and a second frame apart from each other, the first frame including a first guide rail and a retracting rail, the second frame including a second guide rail; and a process cartridge including a cartridge frame and a photosensitive drum supported by the cartridge frame, the photosensitive drum being rotatable about an axis extending in an axial direction, the process cartridge being attachable to the apparatus main body in an attachment direction, one end of the process cartridge in the axial direction being supported by the first frame, an other end of the process cartridge in the axial direction being supported by the second frame, the cartridge frame including:

a protruding rib protruding toward the first frame, the first guide rail configured to, when the process cartridge is attached to the apparatus main body, guide the protruding rib to slide along the first guide rail;

a protruding member protruding toward the first frame, the retracting rail configured not to interfere with the protruding member when the process cartridge is attached to the apparatus main body;

a first bearing supporting one end of the photosensitive drum in the axial direction; and a second bearing supporting an other end of the photosensitive drum in the axial direction, the second guide rail configured to, when the process cartridge is attached to the apparatus main body, guide the second bearing to slide along the second guide rail, a size of the first guide rail in a width direction perpendicular to both the axial direction and the attachment direction being smaller than a size of the second guide rail in the width direction, wherein the process cartridge includes a development roller supported by the cartridge frame, the development roller being movable between a contact position at which the development roller contacts the photosensitive drum and a separation position at which the development roller is separated from the photosensitive drum; and wherein the protruding member includes an arm supported by the cartridge frame, a protruding amount of the arm toward the first frame being larger than a protruding amount of the protruding rib toward the first frame, the arm being for moving the development roller between the contact position and the separation position.

2. The image forming apparatus according to claim 1, wherein the first frame has a first side surface facing the process cartridge in the axial direction;

wherein the first guide rail has a first guide surface located farther outward than the first side surface in the axial direction; and wherein the retracting rail has a retracting surface located farther outward than the first side surface and the first guide surface in the axial direction, the retracting surface being configured not to interfere with the arm when the process cartridge is attached to the apparatus main body.

3. The image forming apparatus according to claim 2, wherein the apparatus main body includes a boss supported by the first frame, the boss penetrating through the retracting surface in the axial direction and protruding toward the process cartridge, the boss being movable between a pressing position at which the boss presses the arm and a retracted position at which the boss is separated from the arm;

wherein the first guide rail has a step surface between the first guide surface and the first side surface in the width direction; and wherein the step surface includes a restricting portion configured to, when the process cartridge is attached to the apparatus main body, contact the protruding rib and restrict a trajectory of the arm to a position at which the arm does not interfere with the boss located at the retracted position.

4. The image forming apparatus according to claim 1, wherein the first frame has a first side surface facing the process cartridge in the axial direction;

wherein the first guide rail has a first guide surface located farther outward than the first side surface in the axial direction;

wherein the retracting rail has an arm retracting surface located farther outward than the first side surface and the first guide surface in the axial direction, the arm retracting surface being configured not to interfere with the arm when the process cartridge is attached to the apparatus main body; and wherein a difference between a position of the arm retracting surface and a position of the first guide surface in the axial direction is equal to or larger than a difference between the protruding amount of the arm toward the first frame and the protruding amount of the protruding rib toward the first frame.

5. The image forming apparatus according to claim 1, wherein the protruding rib is located at a position spaced from the first bearing; and wherein the protruding rib is located upstream of the first bearing in the attachment direction.

6. An image forming apparatus comprising:

an apparatus main body including a first frame and a second frame apart from each other, the first frame including a first guide rail and a retracting rail, the second frame including a second guide rail; and a process cartridge including a cartridge frame and a photosensitive drum supported by the cartridge frame, the photosensitive drum being rotatable about an axis extending in an axial direction, the process cartridge being attachable to the apparatus main body in an attachment direction, one end of the process cartridge in the axial direction being supported by the first frame, an other end of the process cartridge in the axial direction being supported by the second frame, the cartridge frame including:

a protruding rib protruding toward the first frame, the first guide rail configured to, when the process cartridge is attached to the apparatus main body, guide the protruding rib to slide along the first guide rail;

a protruding member protruding toward the first frame, the retracting rail configured not to interfere with the protruding member when the process cartridge is attached to the apparatus main body;

a first bearing supporting one end of the photosensitive drum in the axial direction; and a second bearing supporting an other end of the photosensitive drum in the axial direction, the second guide rail configured to, when the process cartridge is attached to the apparatus main body, guide the second bearing to slide along the second guide rail, a size of the first guide rail in a width direction perpendicular to both the axial direction and the attachment direction being smaller than a size of the second guide rail in the width direction, wherein the apparatus main body includes a lock lever supported by the first frame, the lock lever being configured to press and fix the photosensitive drum in a state where the process cartridge is attached to the apparatus main body; and wherein the protruding member includes a lever contact portion formed at the first bearing and configured to be contacted by the lock lever, a protruding amount of the lever contact portion toward the first frame being equal to a protruding amount of the protruding rib toward the first frame.

7. The image forming apparatus according to claim 6, wherein the first frame has a first side surface facing the process cartridge in the axial direction;

wherein the first guide rail has a first guide surface located farther outward than the first side surface in the axial direction; and wherein the retracting rail has a retracting surface located farther outward than the first side surface in the axial direction and located at a same position as the first guide surface in the axial direction, the retracting surface being configured not to interfere with the lever contact portion when the process cartridge is attached to the apparatus main body.

8. An image forming apparatus comprising:

an apparatus main body including a first frame and a second frame apart from each other, the first frame including a first guide rail and a retracting rail, the second frame including a second guide rail; and a process cartridge including a cartridge frame and a photosensitive drum supported by the cartridge frame, the photosensitive drum being rotatable about an axis extending in an axial direction, the process cartridge being attachable to the apparatus main body in an attachment direction, one end of the process cartridge in the axial direction being supported by the first frame, an other end of the process cartridge in the axial direction being supported by the second frame, the cartridge frame including:

a protruding rib protruding toward the first frame, the first guide rail configured to, when the process cartridge is attached to the apparatus main body, guide the protruding rib to slide along the first guide rail;

a protruding member protruding toward the first frame, the retracting rail configured not to interfere with the protruding member when the process cartridge is attached to the apparatus main body;

a first bearing supporting one end of the photosensitive drum in the axial direction; and a second bearing supporting an other end of the photosensitive drum in the axial direction, the second guide rail configured to, when the process cartridge is attached to the apparatus main body, guide the second bearing to slide along the second guide rail, a size of the first guide rail in a width direction perpendicular to both the axial direction and the attachment direction being smaller than a size of the second guide rail in the width direction, wherein the process cartridge includes a charger supported by the cartridge frame and configured to charge the photosensitive drum; and wherein the protruding member includes an electrode supported by the cartridge frame, a protruding amount of the electrode toward the first frame being smaller than a protruding amount of the protruding rib toward the first frame, the electrode being for supplying power to the charger.

9. The image forming apparatus according to claim 8, wherein the first frame has a first side surface facing the process cartridge in the axial direction;

wherein the first guide rail has a first guide surface located farther outward than the first side surface in the axial direction; and wherein the retracting rail has a retracting surface located farther outward than the first side surface and farther inward than the first guide surface in the axial direction, the retracting surface being configured not to interfere with the electrode when the process cartridge is attached to the apparatus main body.

10. The image forming apparatus according to claim 8, wherein the first frame has a first side surface facing the process cartridge in the axial direction;

wherein the first guide rail has a first guide surface located farther outward than the first side surface in the axial direction;

wherein the retracting rail has an electrode retracting surface located farther outward than the first side surface and farther inward than the first guide surface in the axial direction, the electrode retracting surface being configured not to interfere with the electrode when the process cartridge is attached to the apparatus main body; and wherein a difference between a position of the electrode retracting surface and the position of the first guide surface in the axial direction is equal to or smaller than a difference between the protruding amount of the electrode toward the first frame and the protruding amount of the protruding rib toward the first frame.

11. An image forming apparatus comprising:

an apparatus main body including a first frame and a second frame apart from each other, the first frame including a first guide rail and a retracting rail, the second frame including a second guide rail; and a process cartridge including a cartridge frame and a photosensitive drum supported by the cartridge frame, the photosensitive drum being rotatable about an axis extending in an axial direction, the process cartridge being attachable to the apparatus main body in an attachment direction, one end of the process cartridge in the axial direction being supported by the first frame, an other end of the process cartridge in the axial direction being supported by the second frame, the cartridge frame including:

a protruding rib protruding toward the first frame, the first guide rail configured to, when the process cartridge is attached to the apparatus main body, guide the protruding rib to slide along the first guide rail;

a protruding member protruding toward the first frame, the retracting rail configured to, when the process cartridge is attached to the apparatus main body, guide the protruding member to slide along the retracting rail;

a first bearing supporting one end of the photosensitive drum in the axial direction; and a second bearing supporting an other end of the photosensitive drum in the axial direction, the second guide rail configured to, when the process cartridge is attached to the apparatus main body, guide the second bearing to slide along the second guide rail, a size of the first guide rail in a width direction perpendicular to both the axial direction and the attachment direction being smaller than a size of the second guide rail in the width direction, wherein each of the protruding rib and the protruding member is located at a position spaced from the first bearing in a plane perpendicular to the axial direction; and wherein each of the protruding rib and the protruding member is located upstream of the first bearing in the attachment direction.

12. The image forming apparatus according to claim 11, wherein the attachment direction is inclined relative to a vertical direction such that an upstream side of the process cartridge in the attachment direction is located farther toward one side in a horizontal direction than a downstream side of the process cartridge in the attachment direction, the horizontal direction being perpendicular to the axial direction; and wherein the first guide rail is located farther toward the one side in the horizontal direction than the retracting rail.

13. The image forming apparatus according to claim 11, wherein the apparatus main body includes:

a top cover covering an upper side of the apparatus main body; and an exposure device supported by the top cover and configured to expose the photosensitive drum;

wherein the first frame has a first side surface facing the process cartridge in the axial direction;

wherein the first guide rail has:

a first guide surface located farther outward than the first side surface in the axial direction;

a first step surface formed between the first side surface and one end of the first guide surface in the width direction; and a second step surface formed between the first side surface and an other end of the first guide surface in the width direction;

wherein the first step surface includes a first exposure positioning portion configured to contact the exposure device, thereby restricting movement of the exposure device toward one side in a horizontal direction perpendicular to the axial direction; and wherein the second step surface includes a second exposure positioning portion configured to contact the exposure device, thereby restricting movement of the exposure device toward an other side in the horizontal direction.

14. The image forming apparatus according to claim 11, wherein the first frame has a first side surface facing the process cartridge in the axial direction;

wherein the first guide rail has:

a first guide surface located farther outward than the first side surface in the axial direction;

a first step surface formed between the first side surface and one end of the first guide surface in the width direction; and a second step surface formed between the first side surface and an other end of the first guide surface in the width direction;

wherein the first step surface includes a first rib positioning portion configured to contact the protruding rib, thereby restricting movement of the process cartridge toward one side in the width direction; and wherein the second step surface includes a second rib positioning portion configured to contact the protruding rib, thereby restricting movement of the process cartridge toward an other side in the width direction.

15. The image forming apparatus according to claim 11, wherein the apparatus main body includes:

a top cover covering an upper side of the apparatus main body; and an exposure device supported by the top cover and configured to expose the photosensitive drum;

wherein the first frame has a first side surface facing the process cartridge in the axial direction;

wherein the first guide rail has:

a first guide surface located farther outward than the first side surface in the axial direction;

a first step surface formed between the first side surface and one end of the first guide surface in the width direction; and a second step surface formed between the first side surface and an other end of the first guide surface in the width direction;

wherein the first step surface includes:

a first exposure positioning portion configured to contact the exposure device, thereby restricting movement of the exposure device toward one side in a horizontal direction perpendicular to the axial direction; and a first rib positioning portion configured to contact the protruding rib, thereby restricting movement of the process cartridge toward one side in the width direction;

wherein the second step surface includes:

a second exposure positioning portion configured to contact the exposure device, thereby restricting movement of the exposure device toward an other side in the horizontal direction; and a second rib positioning portion configured to contact the protruding rib, thereby restricting movement of the process cartridge toward an other side in the width direction; and wherein the first rib positioning portion and the second rib positioning portion are arranged downstream of the first exposure positioning portion and the second exposure positioning portion in the attachment direction.

16. The image forming apparatus according to claim 11, wherein the first frame has:

a first side surface facing the process cartridge in the axial direction; and a drum positioning portion located farther inward than the first side surface in the axial direction, the drum positioning portion being configured to contact the first bearing to position the photosensitive drum in a state where the process cartridge is attached to the apparatus main body.

17. The image forming apparatus according to claim 11, wherein the process cartridge is configured to be attached to the apparatus main body from above; and wherein, when the process cartridge is in a posture of being attached to the apparatus main body, the protruding rib is located at a lower side of the cartridge frame.

18. The image forming apparatus according to claim 11, wherein the process cartridge is configured to be attached to the apparatus main body from above; and wherein, when the process cartridge is in a posture of being attached to the apparatus main body, a part of the protruding rib overlaps the photosensitive drum as viewed from a horizontal direction.

19. The image forming apparatus according to claim 11, wherein the apparatus main body further includes a third frame to which the first frame is attached, the third frame being located farther outward than the first frame in the axial direction.

* * * * *